US005228218A

United States Patent [19]

Bonnaventure

[11] Patent Number: 5,228,218

[45] Date of Patent: Jul. 20, 1993

[54] REAR ENTRY SKI BOOT WITH REAR LINER TONGUE

[75] Inventor: Laurent Bonnaventure, Cran Gevrier, France

[73] Assignee: Salomon S.A., Chavanod, France

[21] Appl. No.: 804,055

[22] Filed: Dec. 9, 1991

[30] Foreign Application Priority Data

Dec. 7, 1990 [FR] France ..... 90 15519

[51] Int. Cl.[5] ..... A43B 5/04

[52] U.S. Cl. ..... 36/117; 36/55

[58] Field of Search ..... 36/117-121, 36/105, 109, 10, 55, 71, 99, 43, 132, 136, 54

[56] References Cited

U.S. PATENT DOCUMENTS

| | | | |
|---|---|---|---|
| 4,154,009 | 5/1979 | Kubelka et al. | 36/119 |
| 4,268,931 | 5/1981 | Salomon | 36/117 |
| 4,428,130 | 1/1984 | Perotto | 36/117 |
| 4,665,576 | 5/1987 | Limbach | 36/117 |
| 4,901,450 | 2/1990 | Chemello et al. | 36/119 |

FOREIGN PATENT DOCUMENTS

| | | | |
|---|---|---|---|
| 107841 | 5/1984 | European Pat. Off. | 36/117 |
| 279074 | 8/1988 | European Pat. Off. | 36/117 |
| 317889 | 5/1989 | European Pat. Off. | 36/117 |
| 3429284 | 2/1986 | Fed. Rep. of Germany | 36/119 |

*Primary Examiner*—Steven N. Meyers
*Assistant Examiner*—Thomas P. Hilliard
*Attorney, Agent, or Firm*—Pollock, Vande Sande & Priddy

[57] ABSTRACT

Ski boot constituted by a rigid shell (2) composed of a front and a rear cover (6, 5) hinged on a transverse pin (7). A flexible sock (8) is inserted in the shell (2) and comprises a front and rear (**8*a*, 8*b*) liner pressed against the covers (6, 5) respectively, the rear cover receiving an inner covering (11*b*) which may or not be detachable. The rear liner (8*b*) of the sock (8) comprises, on its lower part (8*d*) facing the front liner (8*a*), a downward extension forming a flexible boot-fitting tongue (11*c*) of a length such that it may be extended continuously beginning at the liner (8*b*), along at least the inner portion of the heel (8*c*) of the sock (8**).

8 Claims, 2 Drawing Sheets

REAR ENTRY SKI BOOT WITH REAR LINER TONGUE

FIELD OF THE INVENTION

The present invention relates to a rear-entry alpine ski boot, constituted by a rigid shell of which a lower portion is topped with an upper at least partially hinged to the latter and which is itself constituted by a rear part, or rear cover, that can be folded down over a front part, or front cover, around a transverse pin, said shell being padded internally with a flexible sock. This sock surrounds the foot and the lower part of the leg and is interposed between these latter and the rigid shell. It comprises, in particular, a rear liner suitable for covering a rear-entry opening and a front liner, the two liners being pressed on the above-mentioned rear and front covers respectively and made of a foam forming a support receiving a comfort covering, whether detachable or non-detachable.

BACKGROUND OF THE INVENTION

In conventional boots of this kind, one major problem lies in ensuring continuous, unobstructed sliding movement of the heel when the foot is inserted in the sock or when it is removed.

In fact, in the above-mentioned boot the rear portion of the rear opening of the sock is bounded by an edge constituting the top portion of the heel of the sock, and in proximity to which the lower end of the rear liner is located, so that this liner covers the opening, or the edge of the heel, when the rear cover is closed over the front cover. It should be noted, however, that if, in the closed position, the lower end of the rear liner is positioned substantially continuously with the edge of the heel of the sock, this is not the case in the open position, precisely when the foot is inserted. In fact, since the rear liner is moved by the rear cover to which it is attached, an angular separation of the lower end of the rear liner from the edge of the heel is created in the area in which the rear cover is joined to the shell base, forming a gap which breaks the continuity of the assembly. In use, such a gap causes the heel of the user to be stopped against the above-mentioned edge of the rear portion of the sock when the foot is inserted in it. This, in turn, causes edge to become gradually deformed, thus creating a source of discomfort.

To overcome this difficulty, conventional practice calls for positioning a tongue at the rear base of the front liner, and more specifically on the lower portion of the rear opening of the sock. This tongue is glued or stitched and comprises a free end extending upward. It ensures, in fact, that the rear part of the heel will be enclosed, and thus, by covering the above-mentioned opening for insertion of the foot, closes it and promotes tightening of the lateral edges of the opening.

In this case, the rear liner is made in two parts, one pressed on the rear cover and the other, i.e., the tongue, which is positioned to the rear of the front liner. This leads to a special arrangement of the tongue, so that its junction with the part of the rear liner attached to the cover is secured without discontinuity, so as to avoid harmful raised areas.

Moreover and above all, as regards comfort when the boot is put on, it is often necessary to manipulate the tongue manually in order to move it aside when the foot is inserted, i.e., to prevent the foot from pushing the tongue downward.

To overcome these difficulties, the creation of a one-piece sock, i.e., without hinged rear liner, has also been suggested.

In the case of a rear-entry boot, it nevertheless proved necessary to provide for possible pivoting of the rear part of the one-piece sock so as to allow insertion of the foot.

To this end, a sock comprising two lateral folds forming a bellows was devised; this arrangement allows the front and rear parts of the sock to follow the opening and closing movements of the front and rear covers.

However, this technique entails other kinds of disadvantages, including the necessity of adapting a very sophisticated molding procedure and the creation of, other areas of discomfort, this time in the area of the folds.

SUMMARY OF THE INVENTION

The object of the present invention is to overcome all of these difficulties and, to this end, relates to a boot of the above-mentioned type in which the lower part of the rear liner of the sock, facing the front liner, comprises a downward extension piece forming a flexible boot-fitting tongue whose length is such as to allow continuous extension beginning at this liner, at least along the inner part of the heel of the sock.

This construction prevents the rear part of the sock forming the heel from being turned inside out when the foot is inserted.

According to another feature of the invention, the boot-fitting tongue has a length such that it extends along the inner part of the heel of the sock and a rear portion of the inner sole which forms its bottom.

Thus, it is the user's heel itself which immobilizes the tongue both in its vertical and horizontal part. The boot-fitting tongue is preferably an extension of the comfort covering of the rear liner.

According to another feature of the invention, the free end of the boot-fitting tongue comprises movable attachment means positioned on the surface facing the sole of the sock, and which are formed from a self-gripping hook-and-buckle system mounted on the parts corresponding to one another.

This construction prevents the tongue from being turned inside out when the boot is removed. Furthermore, the rear liner remains independent and movable in relation to the rest of the sock. In this configuration, the tongue provides additional comfort, especially at a right angle to the fold of the heel of the sock, and forms a flexible hinge in that area.

BRIEF DESCRIPTION OF THE DRAWINGS

The following description, provided with reference to the attached drawings will assist in an understanding of the implementation of the invention.

DETAILED DESCRIPTION

Figure 1:
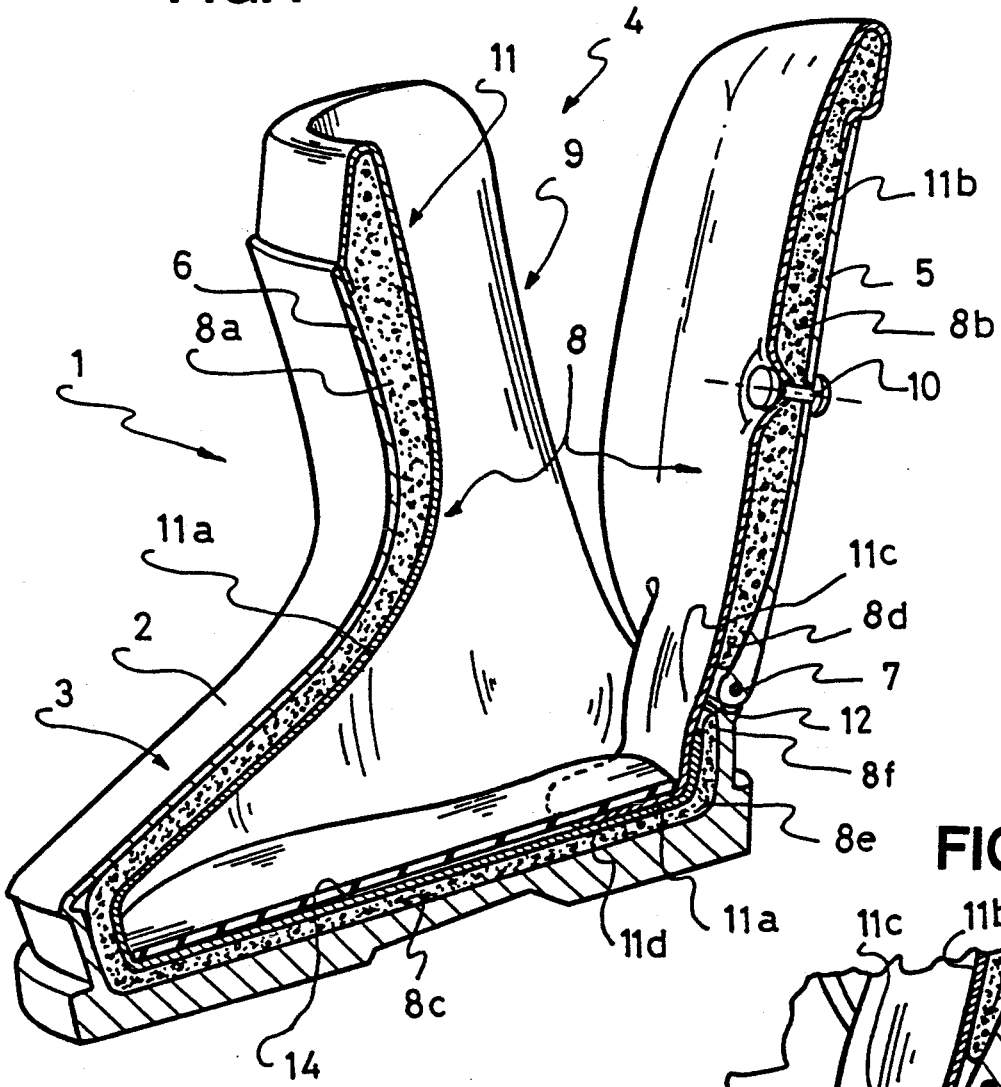
FIG. 1 is a perspective view along a longitudinal cross-section of a boot provided with a rear liner according to the invention.

In accordance with the invention, the ski boot 1 in FIG. 1 comprises a rigid shell 2 having a shell base 3 is topped by an upper 4 which is at least partially hinged on the latter using lateral articulation means of an area of flexion (not shown).

In this embodiment, the upper 4 is constituted by a rear part 5, or rear cover, which is pivotable relative to a front part 6, or front cover, about a transverse pin 7 passing through lateral extensions in the lower, rear part of the shell 2.

The shell 2 is padded internally with a flexible sock 8 which surrounds the foot and the lower part of the leg, and which is inserted between these latter and the rigid shell 2. The sock comprises, first, a rear liner **8*b* suitable for covering a rear foot-insertion opening 9 of the sock 8, and second, a front liner 8*a*. The two liners 8*b* and 8*a* are connected to the rear 5 and front 6 covers, respectively. In this embodiment, liner 8*a* is secured by being fitted into the front cover 6 and the shell base 3 and the liner 8*b* by means of a clip 10 which passes through both the liner 8*b* and the cover 5**.

The sock 8 is conventionally manufactured of poured or molded foam, for example, and forms a support for an inner comfort lining 11 which may or may not be detachable. The lining 11 comprises a portion **11*a* that covers simultaneously the front liner 8*a* and the sole 8*c* making up the bottom of the sock 8, and a portion 11*b* that covers the rear liner 8*b***. The comfort lining can, for example, be made from a jersey-type mesh fabric.

According to the present embodiment, the rear lower part **8*d* of the liner 8*b* of the sock, facing the front liner 8*a*, comprises an extension that extends downward and forms a boot-fitting tongue 11*c*. This boot-fitting tongue 11*c* is advantageously obtained by an extension of portion 11*b* of the comfort lining 11 to the rear liner 8*b***.

Since the comfort lining 11 is, in this instance, made of a jersey-type fabric, the boot-fitting tongue **11*c* thus obtained is flexible and thus capable of adopting the conformation of the inner part of the heel 8*e* of the sock 8 by means of the inserted lining 11*a*. Furthermore, the length of the tongue 11*c* is such as to have a free end 11*d* capable of also being extended without discontinuity over a rear portion of the sole 8*c* forming the bottom of the sock 8. Of course, the boot-fitting tongue 11*c* may also quite easily also be obtained by extending the foam-based support constituting the rear liner 8*b***.

Figure 2:
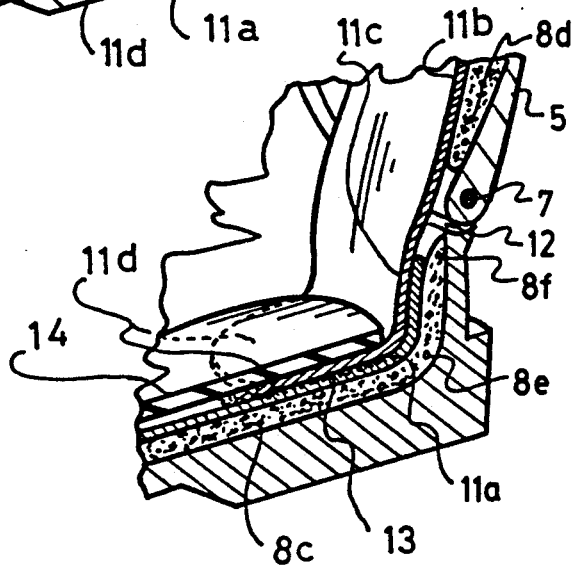
FIG. 2 is an enlarged detail view of the rear part of the boot in FIG. 1.
Figure 3:
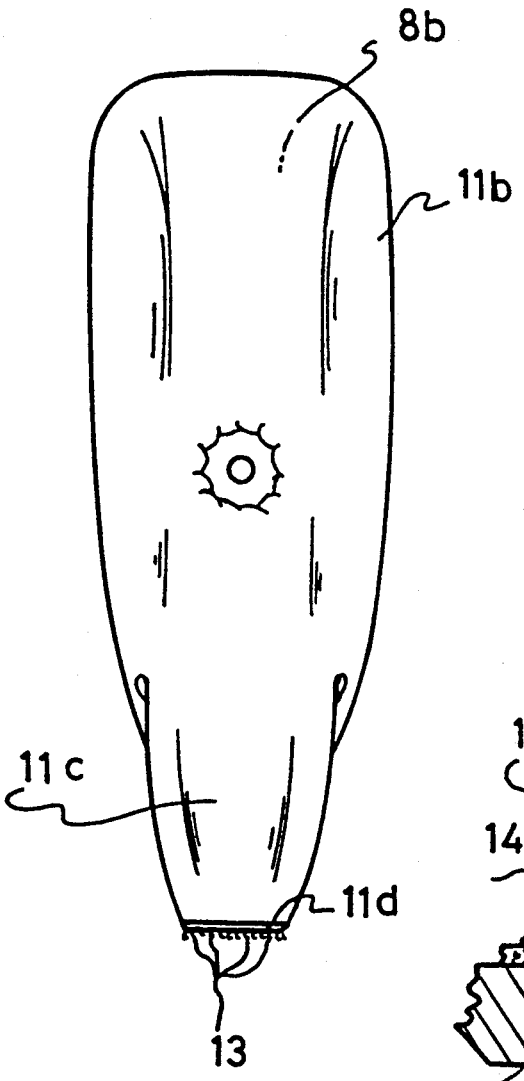
FIG. 3 is a plan view of a rear liner according to the invention, removed from the boot.
Figure 4:
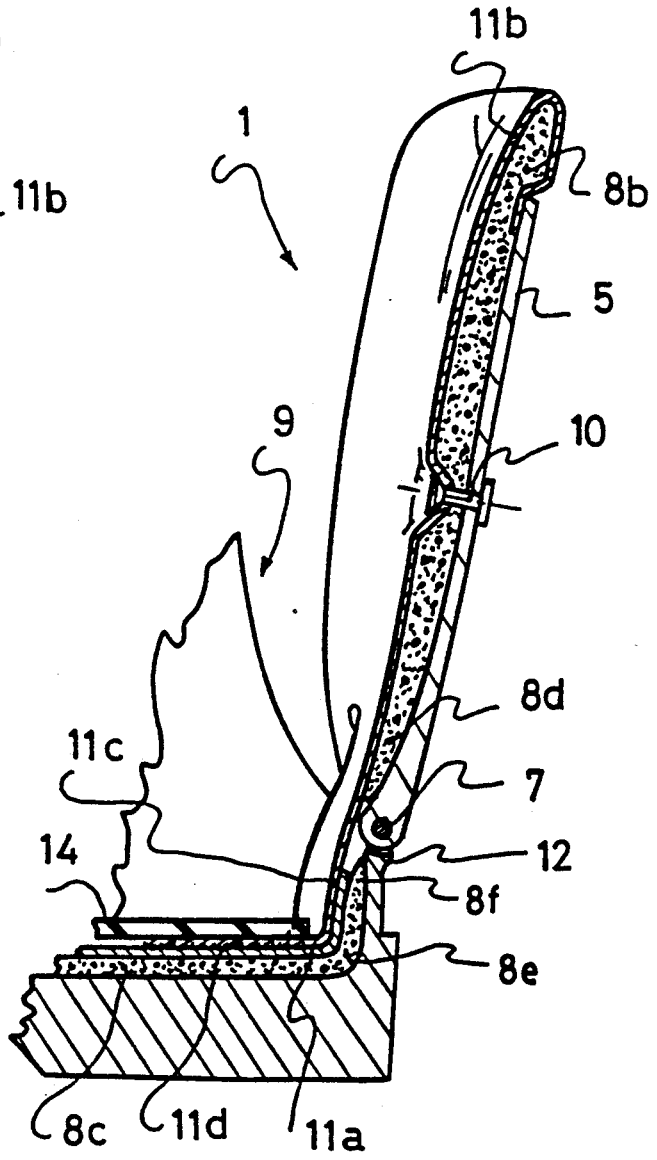
FIG. 4 is a partial longitudinal cross-section of the boot, equipped with the rear liner.

It will be clear from the preceding description and from FIGS. 1, 2, and 4 that the gap 12 formed in the hinge area of the rear liner **8*b* of the shell base 3 thus comes to be covered and removes any risk that, when the boot is put on, the foot will be stopped against the edge 8*f* of the heel 8*e* of the sock 8**.

The free-end portion **11*d* of the tongue 11*c* comprises movable attachment means positioned on its surface facing the sole 8*c* of the sock, and, more specifically, facing the portion 11*a* of the lining 11 which covers it. These attachment means are constituted by a system of hooks 13 arranged on a support mounted on the tongue 11*c* and which are self-gripping on (non-visible) buckles which are either mounted on a support attached to the sole 8*c* or to portion 11*a* of the lining 11**, or formed from the same material as the lining and with a suitable texture.

The movable attachment means of the boot-fitting tongue **11*c* may also, in accordance with a variant (not shown), be formed by an elastic fastening system allowing a snap fastener on the tongue 11*c* to be fitted into a corresponding recess in the inner sole 8*c* which forms the bottom of the sock 8**.

As shown in the drawings, the user's comfort is further enhanced by a movable comfort sole 14 attached inside the sock 8 which covers the sole **8*a* forming the inner bottom of the sock. The free end 11 of the tongue 11*c* provided with the attachment means 13 is thus clamped between soles 8*c* and 11 when the heel of the foot exerts pressure during use. This tends to perfect position maintenance of the tongue 11*c*** and to prevent it from being turned inside out when the boot is removed.

What is claimed is:

1. Rear-entry alpine ski boot constituted by a rigid shell (2) comprising a shell base (3) topped by an upper (4) at least partly hinged on said shell base (3), said upper comprising a rear cover part (5) pivotable relative to a front cover part (6) about a transverse axis (7), said rigid shell (2) having an interior padded with a flexible sock (8) interposed between a foot and lower leg of a user of said ski boot and said rigid shell (2), said flexible sock (8) comprising (a) a rear liner (**8*b*) covering a rear foot-insertion opening (9) in said sock (8); and (b) a front liner (8*a*) with a sole (8*c***);

(c) said rear liner and said front liner respectively being connected to said rear cover part (5) and said front cover part (6), and being made of a foam forming a support for an internal comfort lining (11);

(d) said rear liner (**8*b*) having a lower part (8*d*) with a downward extension piece forming a flexible boot-fitting tongue (11*c*) having a length such that it can extend without discontinuity from said rear liner (8*b*) toward said front liner (8*a*), at least along an inner part of a heel (8*e*) of said sock (8), thereby covering a gap (12) between a pivot zone of said rear liner (8*b*) and said shell base (3), said boot-fitting tongue (11*c*) having a length such that it extends along said inner part of said heel (8*e*) of said sock (8) and along a rear portion of an inner sole (8*c***) constituting a bottom of said sock.

2. Boot according to claim 1, wherein said boot-fitting tongue is an extension of said foam-based support on said rear liner (**8*b***).

3. Boot according to claim 1, wherein said boot-fitting tongue (**11*c*) is an extension of said comfort lining (11*b*) of said rear liner (8*b***).

4. Rear-entry alpine ski boot constituted by a rigid shell (2) comprising a shell base (3) topped by an upper (4) at least partly hinged on said shell base (3), said upper comprising a rear cover part (5) pivotable relative to a front cover part (6) about a transverse axis (7), said rigid shell (2) having an interior padded with a flexible sock (8) interposed between a foot and lower leg of a user of said ski boot and said rigid shell (2), said flexible sock (8) comprising (a) a rear liner (**8*b*) covering a rear foot-insertion opening (9) in said sock (8); and (b) a front liner (8*a*) with a sole (8*c***);

(c) said rear liner and said front liner respectively being connected to said rear cover part (5) and said front cover part (6), and being made of a foam forming a support for an internal comfort lining (11);

(d) said rear liner (**8*b*) having a lower part (8*d*) with a downward extension piece forming a flexible boot-fitting tongue (11*c*) having a length such that it can extend without discontinuity from said rear liner (8***b*) toward said front liner (8*a*), at least along an inner part of a heel (8*e*) of said sock (8), thereby covering a gap (12) between a pivot zone of said rear liner (8*b*) and said shell base (3), said boot-fitting tongue (11*c*) having a free end (11*d*) comprising movable attachment means arranged on a surface of said tongue facing a sole (8*c*) of said sock (8).

5. Boot according to claim 4, wherein said movable attachment means on said boot-fitting tongue (11*c*) comprise a self-gripping system comprising hooks (13) and buckles respectively mounted on associated parts of said sole (8*c*) and said free end (11*d*).

6. Boot according to claim 5, wherein said buckles are carried by said sole (8*c*) and said hooks (13) are carried by said tongue (11*c*).

7. Boot according to claim 6, wherein said buckles are formed by a texture of said internal comfort lining (11*a*) covering said sole (8*c*) of said sock (8).

8. Boot according to claim 4, comprising a movable comfort sole (14) mounted inside said sock (8) so as to cover a sole (8*c*) of said sock so as to clamp said free end (11*d*) of said tongue (11*c*) equipped with said attachment means between said sole of said sock (8*c*) and said movable comfort sole (14) when pressure is exerted by a heel of said foot.

* * * * *